US005533646A

United States Patent [19]

Dildine

[11] Patent Number: 5,533,646

[45] Date of Patent: Jul. 9, 1996

[54] GOLF CART BALL DISPENSER

[76] Inventor: Charles N. Dildine, 100 Sunset Cove, Niceville, Fla. 32578

[21] Appl. No.: 285,149

[22] Filed: Aug. 3, 1994

[51] Int. Cl.[6] ..... G07F 11/04

[52] U.S. Cl. ..... 221/185; 221/191; 221/283; 206/315.9; 206/738

[58] Field of Search ..... 221/185, 191, 221/193, 194, 281, 283, 303; 280/DIG. 5, DIG. 6; 206/44.12, 315.9; 273/320

[56] References Cited

U.S. PATENT DOCUMENTS

| | | | |
|---|---|---|---|
| 1,810,491 | 6/1931 | McClure | 221/185 |
| 2,957,700 | 10/1960 | Beaurline | 280/DIG. 6 X |
| 3,206,067 | 9/1965 | Smith et al. | 221/281 |
| 4,858,784 | 8/1989 | Moody | 221/283 X |
| 5,123,719 | 6/1992 | Oden | 221/194 |
| 5,191,995 | 3/1993 | McDonald | 221/281 X |

*Primary Examiner*—William E. Terrell
*Assistant Examiner*—Dean A. Reichard

[57] ABSTRACT

A golf cart ball dispenser comprising: a rigid tube having a small interior diameter and having a large outside diameter, the tube having an elongated upper linear extent, the tube having a lower curved portion, the curved portion having a radius of curvature with the center of curvature located laterally offset from an intermediate portion of the upper linear extent, the curved portion having an opening on its upper extent, the opening being of a length greater than the small diameter and a width greater than the small diameter; and an end cap at the end of the curved portion remote from the upper linear extent to retain golf balls therein.

4 Claims, 4 Drawing Sheets

GOLF CART BALL DISPENSER

BACKGROUND OF THE INVENTION

1. Field of the Invention

The present invention relates to a golf cart ball dispenser and more particularly pertains to storing a large number of golf balls in a dispenser mounted to a golf cart for easy access.

2. Description of the Prior Art

The use of containers and dispensers for golf balls of a wide variety of designs and configurations is known in the prior art. More specifically, containers and dispensers for golf balls of a wide variety of designs and configurations heretofore devised and utilized for the purpose of storing and/or supporting and/or containing and/or dispensing objects such as balls through any one of a number of devices designed for a particular purpose are known to consist basically of familiar, expected, and obvious structural configurations, notwithstanding the myriad of designs encompassed by the crowded prior art which has been developed for the fulfillment of countless objects such as balls through any one of a number objectives and requirements.

By way of example, the prior art discloses in U.S. Pat. No. 3,733,086 a golf cart ball dispensing handle construction.

U.S. Pat. No. 4,391,446 discloses a golf ball dispenser.

U.S. Pat. No. 5,183,154 discloses a golf ball holder dispenser.

U.S. Pat. No. Des. 304,750 discloses the design of a golf ball dispenser.

U.S. Pat. No. Des. 321,921 discloses the design of a golf ball dispenser.

In this respect, the golf cart ball dispenser according to the present invention substantially departs from the conventional concepts and designs of the prior art, and in doing so provides an apparatus primarily developed for the purpose of storing a large number of golf balls in a dispenser mounted to a golf cart for easy access.

Therefore, it can be appreciated that there exists a continuing need for a new and improved golf cart ball dispenser which can be used for storing a large number of golf balls in a dispenser mounted to a golf cart for easy access. In this regard, the present invention substantially fulfills this need.

SUMMARY OF THE INVENTION

In view of the foregoing disadvantages inherent in the known types of containers and dispensers for golf balls of a wide variety of designs and configurations now present in the prior art, the present invention provides an improved golf cart ball dispenser. As such, the general purpose of the present invention, which will be described subsequently in greater detail, is to provide a new and improved golf cart ball dispenser and method which has all the advantages of the prior art and none of the disadvantages.

To attain this, the present invention essentially comprises a new and improved golf cart ball dispenser comprising, in combination: a rigid tube having an interior diameter of about $1\frac{13}{16}$ inches and having an exterior diameter of about $1\frac{15}{16}$ inches, the tube having an upper linear extent of about eight inches, the tube having a lower curved portion, the curved portion having a radius of curvature of about six inches with the center of curvature located laterally offset from an intermediate portion of the upper linear extent, the curved portion having an opening on its upper extent, the opening being of a length greater than $1\frac{13}{16}$ inches and a width greater than $1\frac{13}{16}$ inches; an end cap at the end of the curved portion remote from the upper linear extent to retain golf balls therein; coupling components including spaced brackets having first interior parts secured with respect to the upper linear extent of the tube and having separable exterior parts, the interior parts and the exterior parts having horizontally aligned apertures; and threaded bolts positionable through the apertures of the exterior parts and adapted to be removably coupled to the interior parts for coupling therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf cart ball dispenser which has all the advantages of the prior art containers and dispensers for golf balls of a wide variety of designs and configurations and none of the disadvantages.

It is another object of the present invention to provide a new and improved golf cart ball dispenser which may be easily and efficiently manufactured and marketed.

It is a further object of the present invention to provide new and improved golf cart ball dispensers which are of durable and reliable constructions.

An even further object of the present invention is to provide new and improved golf cart ball dispensers which are susceptible of a low cost of manufacture with regard to both materials and labor, and which accordingly are then susceptible of low prices of sale to the consuming public, thereby making such golf cart ball dispenser economically available to the buying public.

Still yet another object of the present invention is to provide new and improved golf cart ball dispensers which provide in the apparatuses and methods of the prior art some of the advantages thereof, while simultaneously overcoming some of the disadvantages normally associated therewith.

Still another object of the present invention is to store a large number of golf balls in a dispenser mounted to a golf cart for easy access.

Lastly, it is an object of the present invention to provide an improved golf cart ball dispenser comprising: a rigid tube having a small interior diameter and having a large outside diameter, the tube having an elongated upper linear extent, the tube having a lower curved portion, the curved portion having a radius of curvature with the center of curvature located laterally offset from an intermediate portion of the upper linear extent, the curved portion having an opening on its upper extent, the opening being of a length greater than the small diameter and a width greater than the small diameter; and an end cap at the end of the curved portion remote from the upper linear extent to retain golf balls therein.

These together with other objects of the invention, along with the various features of novelty which characterize the invention, are pointed out with particularity in the claims annexed to and forming a part of this disclosure. For a better understanding of the invention, its operating advantages and the specific objects such as balls through any one of a number of uses attained by its uses, reference should be had to the accompanying drawings and descriptive matter in which there are illustrated preferred embodiments of the invention.

BRIEF DESCRIPTION OF THE DRAWINGS

The invention will be better understood and objects such as balls through any one of a number of uses other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
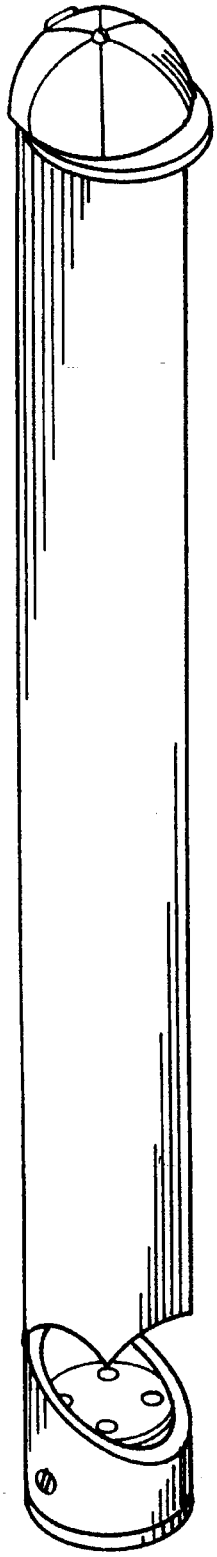
FIG 1 PRIOR ART
FIG. 1 is a perspective view of one particular prior art type of golf ball dispenser.
Figure 2:
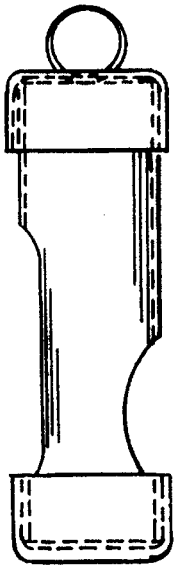
FIG 2 PRIOR ART
FIG. 2 is a front elevational view of another type of prior art golf ball dispenser.
Figure 4:
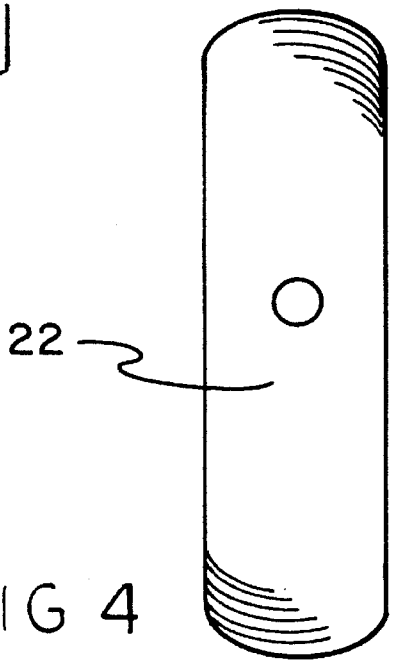
FIG. 4 is a bottom view of the dispenser taken along lines 4—4 of FIG. 3.
Figure 3:
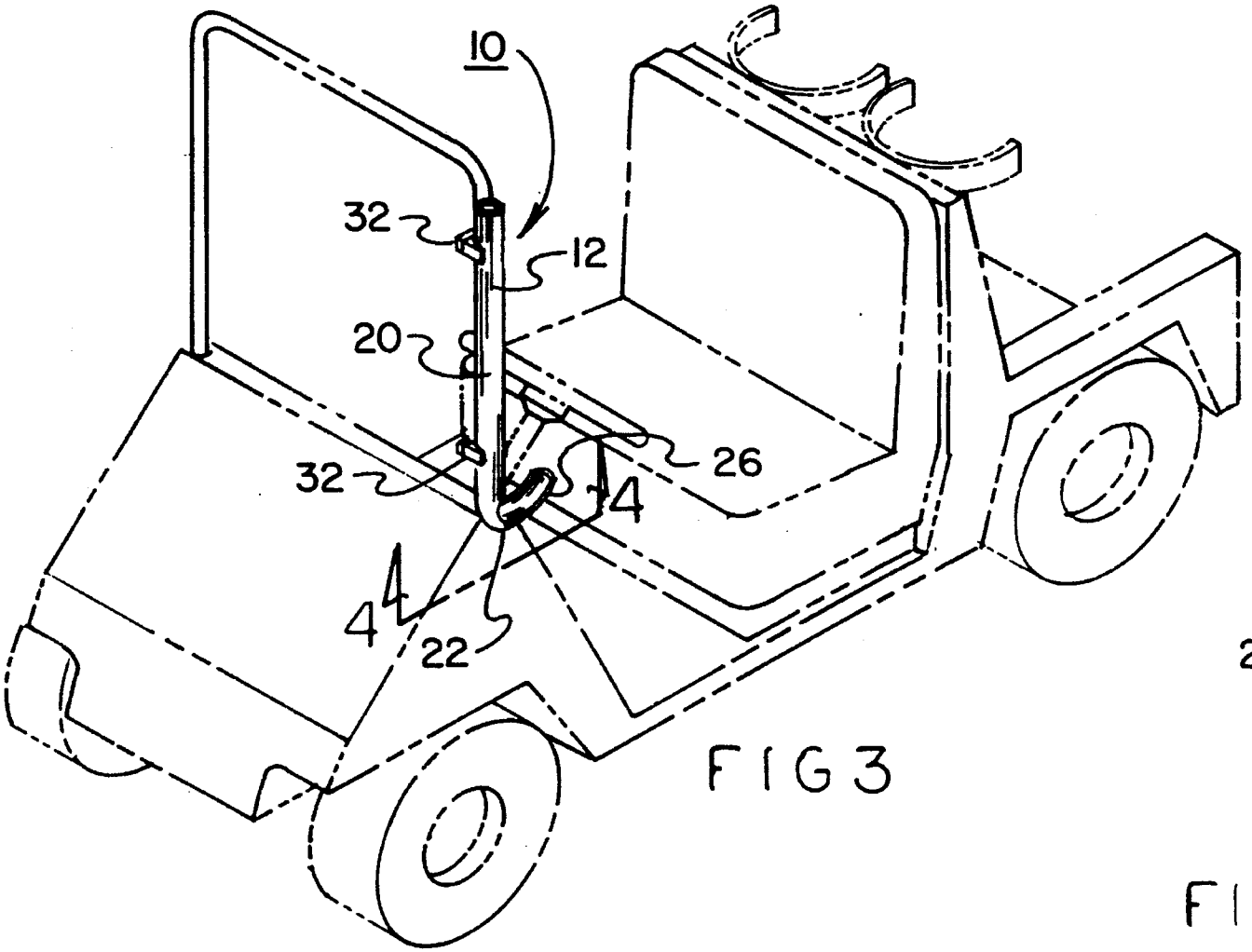
FIG. 3 is a perspective illustration of a golf cart and including the preferred embodiment of the new and improved golf cart ball dispenser constructed in accordance with the principles of the present invention.
Figure 5:
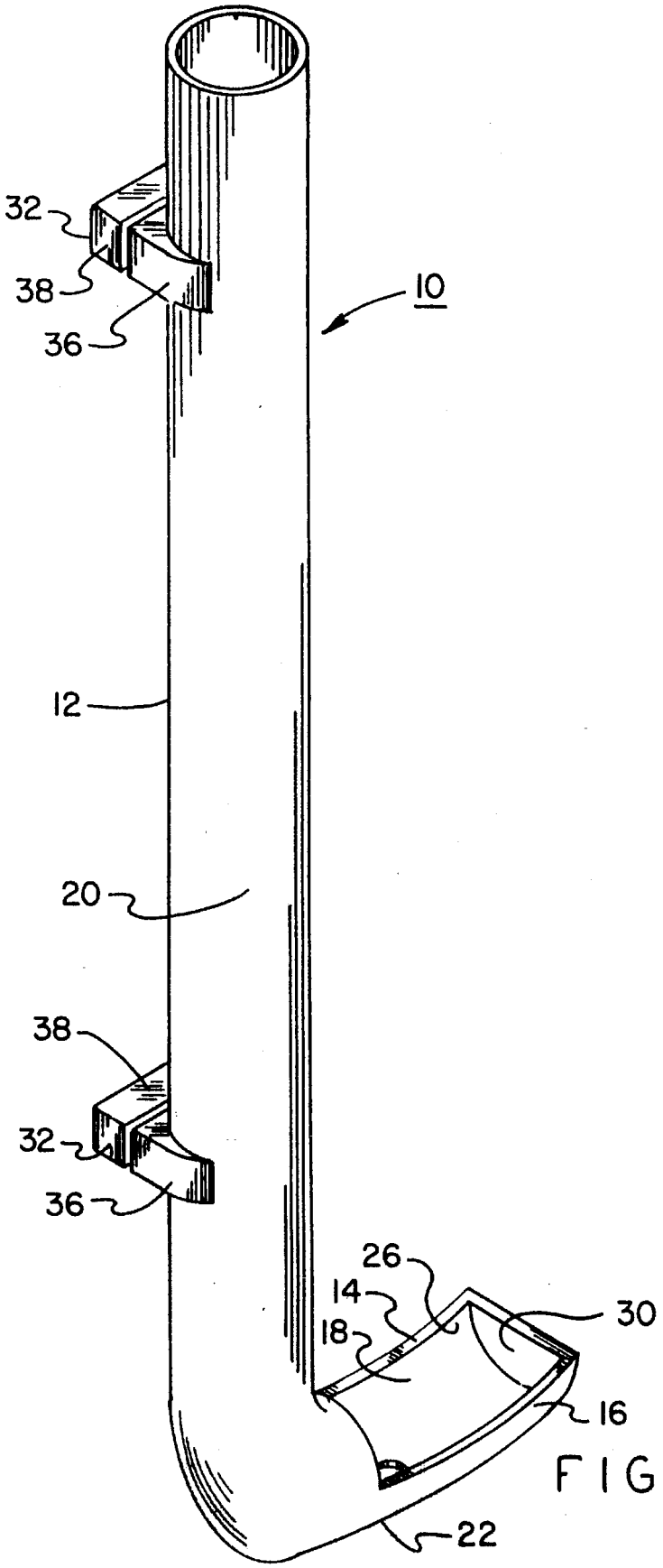
FIG. 5 is a perspective illustration of the dispenser shown in FIGS. 3 and 4.
Figure 7:
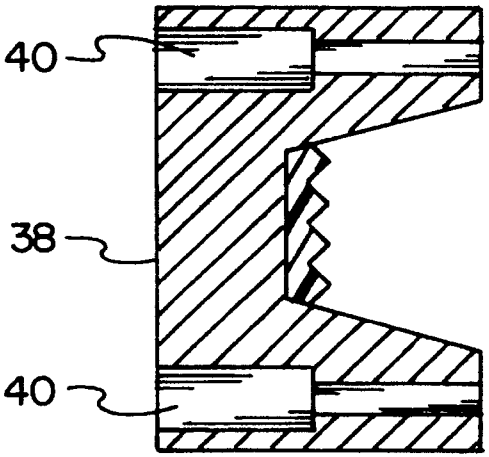
FIG. 7 is a cross-sectional view taken along lines 7—7 of FIG. 6.
Figure 6:
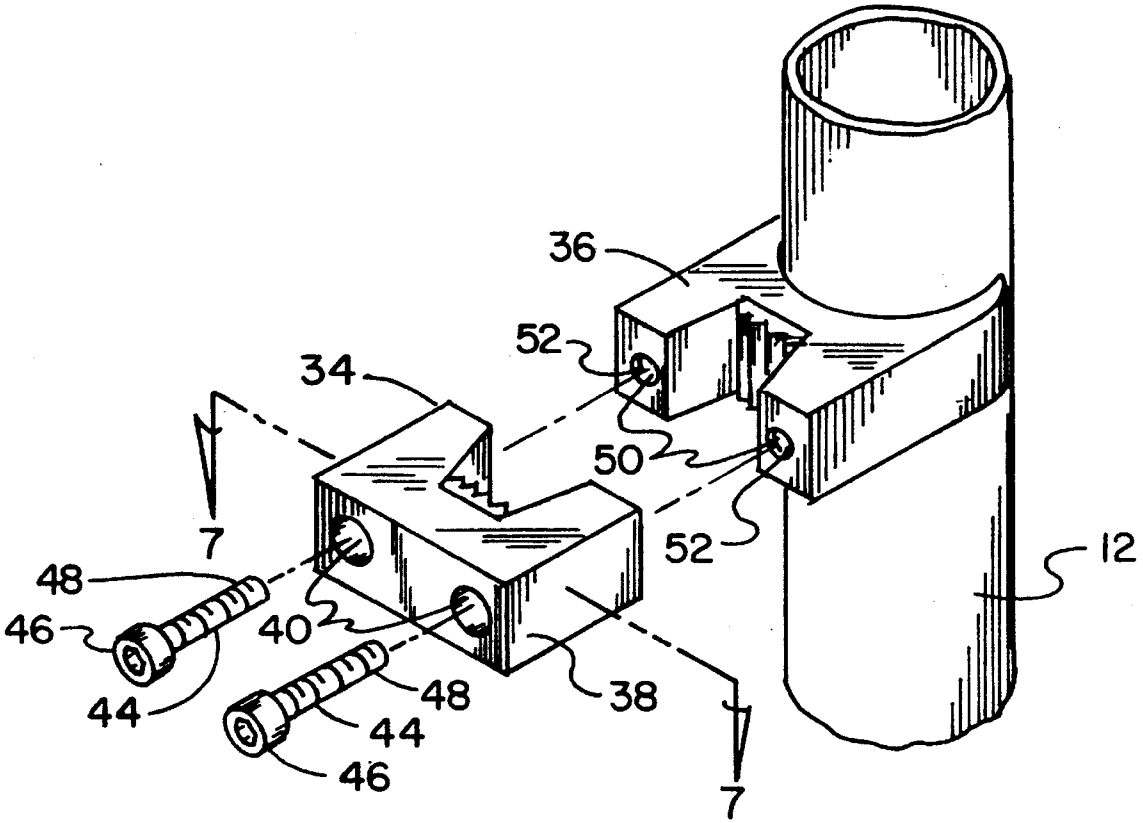
FIG. 6 is an exploded perspective view of one coupling component for securing the dispenser to a portion of the golf cart.

With reference now to the drawings, and in particular to FIG. 3 thereof, the preferred embodiment of the new and improved golf cart ball dispenser embodying the principles and concepts of the present invention and generally designated by the reference numeral 10 will be described.

The present invention, the new and improved golf cart ball dispenser, is a system comprised of a plurality of components. Such components, in their broadest context, include a rigid tube, an end cap, coupling components and threaded bolts. Such components are individually configured and correlated with respect to each other so as to attain the desired objective.

More specifically the central component of the present system 10 is a rigid tube 12. Such tube has an interior diameter of about 1 3/16 inches. This is to allow the free receipt and movement of a conventional sized golf ball therein. The tube has an exterior diameter of about 1 15/16 inches. As such, a thin wall 14 is generated between the exterior surface 16 which is circular in cross-section and the interior surface 18 which also has a circular cross-section. The tube 12 has an upper linear extent 20. Such linear extent is of about eight inches in length and normally extends in a vertical orientation. In addition, the tube 12 has a lower curved portion 22. The curved portion has a radius of curvature of about six inches. The center of curvature is located above the curved portion at a location laterally offset from an intermediate portion of the upper extent of the linear extent.

Formed in the rigid tube 12 at the curved portion is an opening 26. The opening is centrally disposed in the central extent of the curved portion. The opening is of a width greater than 1 13/16 inches. This allows a ball from within the tube to be lifted to exterior thereof. The length of the opening is at least greater than the diameter of the golf ball, greater than 1 13/16 inches. In the preferred mode, the opening is between about three and four inches long to allow the selection of any one of a plurality of balls to be pulled from the curved portion upon inspection by a user. The opening extends, preferably, to the free end of the curved portion remote from the linear portion.

The next component of the system 10 is an end cap 30. The end cap is circular in cross-section essentially equal to the exterior diameter of the tube at the lower free end, about 1 15/16 inches. It is located at the end of the curved portion remote from the upper linear extent. It functions to retain golf balls within the tube so that the force of golf balls in the linear extent will not force the balls to exterior of the curved portion of the tube. Next provided are a plurality of coupling components 32. The coupling components include spaced brackets 34. Such brackets have first interior parts 36. Such interior parts are adapted to be secured with respect to the upper linear extent of the tube. The coupling components also include separable exterior parts 38. The interior parts and the exterior parts are provided with horizontal apertures 40 in axial alignment with respect to each other.

Positionable within the apertures of the two parts of the coupling components are threaded bolts 44. The bolts are cylindrical in cross-section with heads 46 at one end sized to preclude movement through the apertures in which they are located. The opposite ends are provided with threads 48 at their exterior ends. They are adapted to be positioned through the apertures as shown to couple the interior and exterior parts for coupling therebetween. Associated nuts 50 with interior threads 52 are used to effect the coupling.

The present invention keeps a large supply of golf balls on hand, ready whenever one is needed, which is usually after one ball has been hit into an out of bounds area, or into a water hazard. These balls are on the golf cart, ready for use, rather than hidden in a golf bag. Therefore little time is wasted before play continues. The playing partners appreciate this feature because golfers are always anxious to move along, since a round of golf requires about four hours to play.

Most golf ball dispensers hold only about four balls. On a bad day, this may not be enough to complete the full eighteen holes, so the present invention contains eighteen balls, which should be sufficient for the entire foursome. The balls are stacked vertically in a plastic tube which is mounted in a convenient location, probably at the front of the golf cart. The tube is curved into a hook at the bottom and cut away diametrically for easy access and removal of a ball. The tube assembly has a maximum inner radius of two inches, so the hook provides enough resistance to permit a ball to drop down to replace the one which was removed, while restraining the remainder from pouring out.

The tube itself has an inside diameter of about one and thirteen sixteenths inches. It may be mounted with clamps or it could have a more finished appearance mounted with dovetail wedges and grooves holding it in place. The dispenser could be supplied in a choice of colors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf cart ball dispenser comprising, in combination:

a rigid tube having an interior diameter of about $1\frac{13}{16}$ inches and having an exterior diameter of about $1\frac{15}{16}$ inches, the tube having an upper linear extent of about eight inches, the tube having a lower curved portion, the curved portion having a radius of curvature of about six inches with the center of curvature located laterally offset from an intermediate portion of the upper linear extent, the curved portion having an opening on an upper portion thereof, the opening being of a length greater than $1\frac{13}{16}$ inches and a width greater than $1\frac{13}{16}$ inches;

an end cap at an end of the curved portion remote from the upper linear extent to retain golf balls in said curved portion, coupling components including spaced brackets having first interior parts secured with respect to the upper linear extent of the tube and having separable exterior parts, the interior parts and the exterior parts having horizontally aligned apertures; and threaded bolts positionable through the apertures of the exterior parts and adapted to be removably coupled to the interior parts for coupling therebetween.

2. A golf cart ball dispenser comprising:

a rigid tube having a small interior diameter and having a large outside diameter, the tube having an elongated upper linear extent, the tube having a lower curved portion, the curved portion having a radius of curvature with the center of curvature located laterally offset from an intermediate portion of the upper linear extent, the curved portion having an opening on an upper portion thereof, the opening being of a length greater than the small diameter and a width greater than the small diameter; and an end cap at an end of the curved portion remote from the upper linear extent to retain golf balls in said curved portion.

3. The dispenser as set forth in claim 2 and further including: coupling components including spaced brackets having first interior parts secured with respect to the upper linear extent of the tube and having separable exterior parts, the interior parts and the exterior parts having horizontally aligned apertures.

4. The dispenser as set forth in claim 3 and further including threaded bolts positionable through the apertures of the exterior member and adapted to be removably coupled to the apertures of the interior member.

* * * * *